US008500393B2

(12) United States Patent
Cartwright et al.

(10) Patent No.: US 8,500,393 B2
(45) Date of Patent: Aug. 6, 2013

(54) CHOPPER PUMP

(75) Inventors: John Cartwright, Mount Vernon, OH (US); Eddie Cottrell, Mansfield, OH (US); David Oswalt, Mansfield, OH (US)

(73) Assignee: The Gorman-Rupp Company, Mansfield, OH (US)

( * ) Notice: Subject to any disclaimer, the term of this patent is extended or adjusted under 35 U.S.C. 154(b) by 844 days.

(21) Appl. No.: 12/570,724

(22) Filed: Sep. 30, 2009

(65) Prior Publication Data

US 2010/0092276 A1 Apr. 15, 2010

Related U.S. Application Data

(60) Provisional application No. 61/101,407, filed on Sep. 30, 2008.

(51) Int. Cl.
*F04D 7/04* (2006.01)

(52) U.S. Cl.
USPC ..... 415/121.1; 415/201; 415/173.1; 415/111; 415/206; 415/214.1

(58) Field of Classification Search
USPC ..... 415/111, 112, 121.2, 201, 206, 214.1; 417/423.2
See application file for complete search history.

(56) References Cited

U.S. PATENT DOCUMENTS

| | | | | |
|---|---|---|---|---|
| 3,898,014 | A * | 8/1975 | Meister et al. | 415/56.6 |
| 4,378,093 | A * | 3/1983 | Keener | 241/46.017 |
| 4,454,993 | A * | 6/1984 | Shibata et al. | 241/46.017 |
| 4,913,619 | A * | 4/1990 | Haentjens et al. | 415/172.1 |
| 5,460,482 | A | 10/1995 | Dorsch | |
| 6,224,331 | B1 | 5/2001 | Hayward et al. | |
| 6,447,245 | B1 * | 9/2002 | Oakley et al. | 415/121.1 |
| 7,455,251 | B2 | 11/2008 | Doering et al. | |
| 2007/0069050 | A1 | 3/2007 | Gutwein et al. | |
| 2008/0193276 | A1 | 8/2008 | Racer et al. | |
| 2009/0232639 | A1 * | 9/2009 | Arnold et al. | 415/121.1 |

FOREIGN PATENT DOCUMENTS

WO WO 2007/067532 A2 6/2007

OTHER PUBLICATIONS

International Search Report and Written Opinion of the International Searching Authority issued in International Patent Application No. PCT/US2009/059068, mailed Nov. 17, 2009.

Hayes, John., "Chopper Pumps Digest the Solids" , Pumps & Systems, Anniversary Article, May 1996, pp. 43-47, www.pump-zone.com.

* cited by examiner

*Primary Examiner* — Ninh H Nguyen
(74) *Attorney, Agent, or Firm* — McDermott Will & Emery LLP

(57) ABSTRACT

A pump for chopping solid material in a liquid stream having a volute housing, a rotating cutter with at least one blade parallel to a rotational axis of the rotating cutter, an impeller arranged at an outer circumference of the rotating cutter, and a stationary cutter having at least one blade parallel to the rotational axis of the rotating cutter. The stationary cutter is concentric with the rotating cutter, and the stationary cutter, the rotating cutter and the impeller are all at least partially housed within the volute housing. Typically, the rotating cutter has a different number of blades than the stationary cutter. Optionally, the pump, further comprises an inspection cover that is removably attached to the pump, and has an opening large enough to remove the stationary cutter and the rotating cutter from the volute housing.

24 Claims, 11 Drawing Sheets

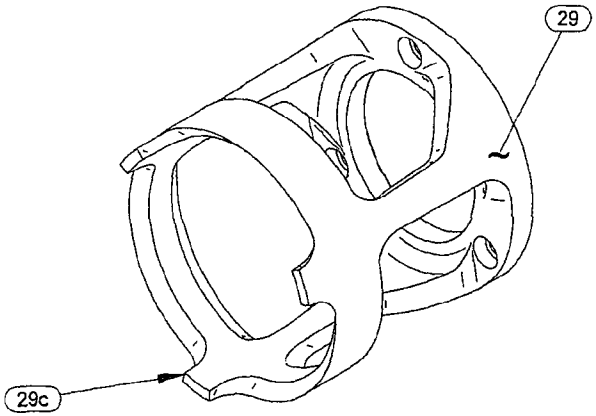
FIG. 10 (SQUARE PROFILE)
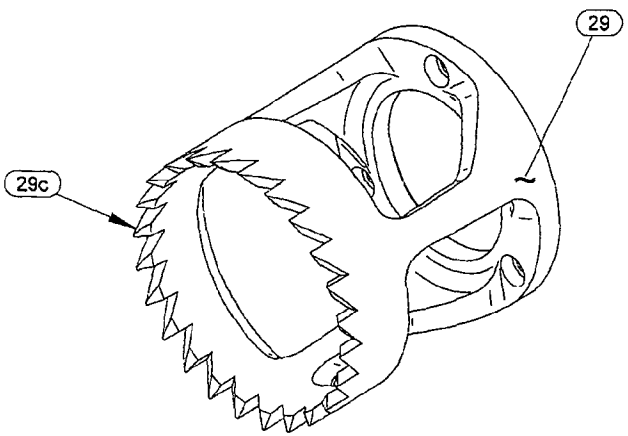
FIG. 12 (SAW TOOTH)
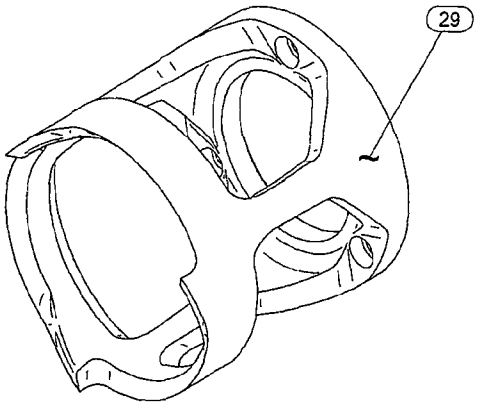
FIG. 9
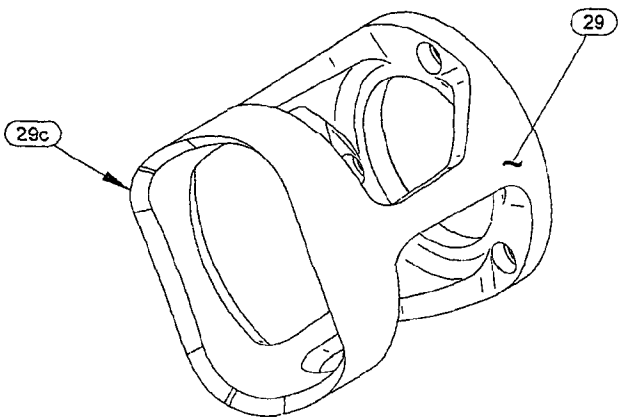
FIG. 11 (SINE WAVE)

CHOPPER PUMP

CROSS REFERENCE TO PROVISIONAL APPLICATION

This application is based upon and claims the benefit of priority from Provisional U.S. Patent Application 61/101,407 filed on Sep. 30, 2008, the entire contents of which are incorporated by reference herein.

TECHNICAL FIELD

The present disclosure relates to pumps for pumping liquids such as water. The present disclosure has particular applicability to pumps equipped with a chopper for cutting solids suspended in the liquid.

BACKGROUND

A myriad of applications exist around the world for pumping suspended solids. In some applications, it is necessary to have the pump cut these solids into smaller pieces as they pass through the pump. Some installations include a separate cutting device ahead of the pump, but in other instances, the cutting occurs within the pump. Other applications require cutting the solids to prevent clogging the pump or another piece of downstream equipment.

One type of clogging problem is related to the pumping of stringy matter. Stringy matter can wrap itself around the leading edge of an impeller vane. Some factors associated with wrapping are related to the matter itself, such as the length of the stringy matter and the concentration of matter in the liquid stream. Other factors controlling wrapping are machine related such as the flow rate or impeller rotational speed. The wrapping of stringy matter is of concern, as once stringy matter is wrapped around the impeller vane, other solids tend to get caught in the matter, resulting in a mass that increases in size. This results in a decrease in pump performance and accordingly, lower flow rate and pump efficiency. A common remedy is to shut the pump down and manually remove this clump in order to return the pump to its desired performance.

Historically, most solids-handling pumps have been designed to allow relatively large solids to pass through the entire pump. This leads to some compromise on performance as the impeller vane profiles are no longer optimized for the best hydraulic performance. A similar approach has been to design the pump with only one vane on the impeller. This, however, can lead to great expense and difficulty in trying to trim and balance the impeller for proper operation. Vortex impeller designs, where the impeller sits recessed out of the flow path, are also commonly used to pump suspended solids.

A removable cover plate, or back cover, allows for more efficient removal of debris. Further advances have included the use of a protrusion into the eye of the impeller to "wipe" any stringy matter off of the impeller vane's leading edge. Other recent developments have focused on two areas: modifying impellers to have one continuous vane instead of multiple vanes or a single vane, and making modifications to wear plates by adding notches and grooves to help disrupt and break up any accumulation of stringy matter that may get caught on the impeller vane's leading edge.

Chopper pumps, referred to as such due to the fact that they cut the solids as they pass through the pump, have been in existence for many years. They are found in numerous applications including, but not limited to: sewage, seafood processing, meat processing plants, paper mills, and manure/agricultural. Some applications for chopper pumps fall under what is referred to as the Ten States Standard that requires municipal wastewater pumps to either pass a 3" spherical solid or to be a chopper pump.

Some applications today that are handled by traditional non-clog pumps are done so in combination with filters, screens, or some other cutting device upstream of the pump. A well applied chopper pump could eliminate the need for these additional devices in certain applications, simplifying the customer's installation in the field. This reduction in complexity often will also lead to improved overall efficiency. Screens and filters can clog over time and become less efficient. In some cases, this reduces the net positive suction head available (NPSHA) to the point where the pump cavitates and operates outside of its preferred operating range. The additional cutting devices can also lead to reduced NPSHA and also require additional power when in operation.

One of the primary limitations of today's chopper pumps is that they rely upon the pump impeller to perform the shearing action. This makes repair and renewal of clearances both expensive and time-consuming. This design feature also renders the pump inoperable without the cutter in place unless a spare impeller is readily available.

Also typical of most chopper pumps commercially available today is that there is a stationary cutter that is positioned perpendicularly to the pump shaft that the solids come in contact with first. This means that the cutting action occurs as the solids flow axially in toward the impeller. For example, U.S. Pat. No. 7,455,251 discloses a chopper pump structured with a chopper plate and impeller that are configured with an open eye or "hubless" arrangement. However, with this configuration, large axial loading can result.

Other limitations of many of today's chopper pumps include the need to remove a heavy cleanout cover plate to inspect the cutters or to remove any clogs and the need to remove the pump from its plumbing to replace worn cutters. Moreover, few conventional chopper pumps operate well on a suction lift.

SUMMARY OF THE DISCLOSURE

The present disclosure provides a pump having a first cutter aligned parallel to the pump shaft. The cutting action occurs as the solid begins to flow radially through the impeller, thus virtually eliminating any axial loading due to the shearing action of the cutters.

In one embodiment of the present disclosure, a pump for chopping solid material in a liquid stream comprises a volute housing, a rotating cutter having at least one blade parallel to a rotational axis of the rotating cutter, an impeller arranged at an outer circumference of the rotating cutter, and a stationary cutter having at least one blade parallel to the rotational axis of the rotating cutter. The stationary cutter is concentric with the rotating cutter, and the stationary cutter, the rotating cutter and the impeller are all at least partially housed within the volute housing. The rotating cutter can have a different number of blades than the stationary cutter.

In another embodiment, the pump, further comprises an inspection cover that is removably attached to the pump, and has an opening large enough to remove the stationary cutter and the rotating cutter from the volute housing.

The disclosure also provides a chopper pump comprising a volute housing, a rotating cutter, a stationary cutter, a back cover assembly housed at least partially within the volute housing, a wear plate attached to the back cover assembly, and an impeller. In one embodiment, the axial clearance between the impeller and the wear plate can be adjusted without affecting the clearance between the rotating cutter and the stationary cutter. Optionally, the chopper pump has a clearance between the impeller and the wear plate that is adjustable by changing the axial location of the back cover assembly.

In another embodiment, the pump further comprises a mechanical seal, a seal oil reservoir, at least one bearing, and an atmospheric vent between the seal oil reservoir and the bearings.

In another embodiment, the impeller further comprises a plurality of vanes protruding radially from the impeller. The number of vanes on the impeller is equal to the number of blades on the rotating cutter. Optionally, the number of vanes on the impeller is a multiple of the number of blades on the rotating cutter.

Also disclosed is a chopper comprising a housing, a rotating cutter having at least one blade parallel to a rotational axis of the rotating cutter and a stationary cutter having at least one blade parallel to the rotational axis of the rotating cutter. The stationary cutter is concentric with the rotating cutter, and the stationary cutter and the rotating cutter are all at least partially housed within the housing. The chopper further comprises an electric motor having a shaft, wherein the rotating cutter is mounted directly on the shaft of the electric motor. The chopper optionally comprises an inspection cover that is removably attached to the housing. Upon removal of the inspection cover an opening is created that is large enough to remove the stationary cutter and the rotating cutter from the housing.

Additional advantages and other features of the present disclosure will be set forth in part in the description which follows and in part will become apparent to those having ordinary skill in the art upon examination of the following or may be learned from the practice of the disclosure. The advantages of the disclosure may be realized and obtained as particularly pointed out in the appended claims.

As will be realized, the present disclosure is capable of other and different embodiments, and its several details are capable of modifications in various obvious respects, all without departing from the disclosure. Accordingly, the drawings and description are to be regarded as illustrative in nature, and not as restrictive.

BRIEF DESCRIPTION OF THE DRAWINGS

Reference is made to the attached drawings, wherein elements having the same reference numeral designations represent like elements throughout, and wherein:

FIGS. 9-12 are isometric views of the rotating cutter showing different protrusion designs according to other embodiments of the present disclosure.

DETAILED DESCRIPTION OF THE DISCLOSURE

Figure 1:
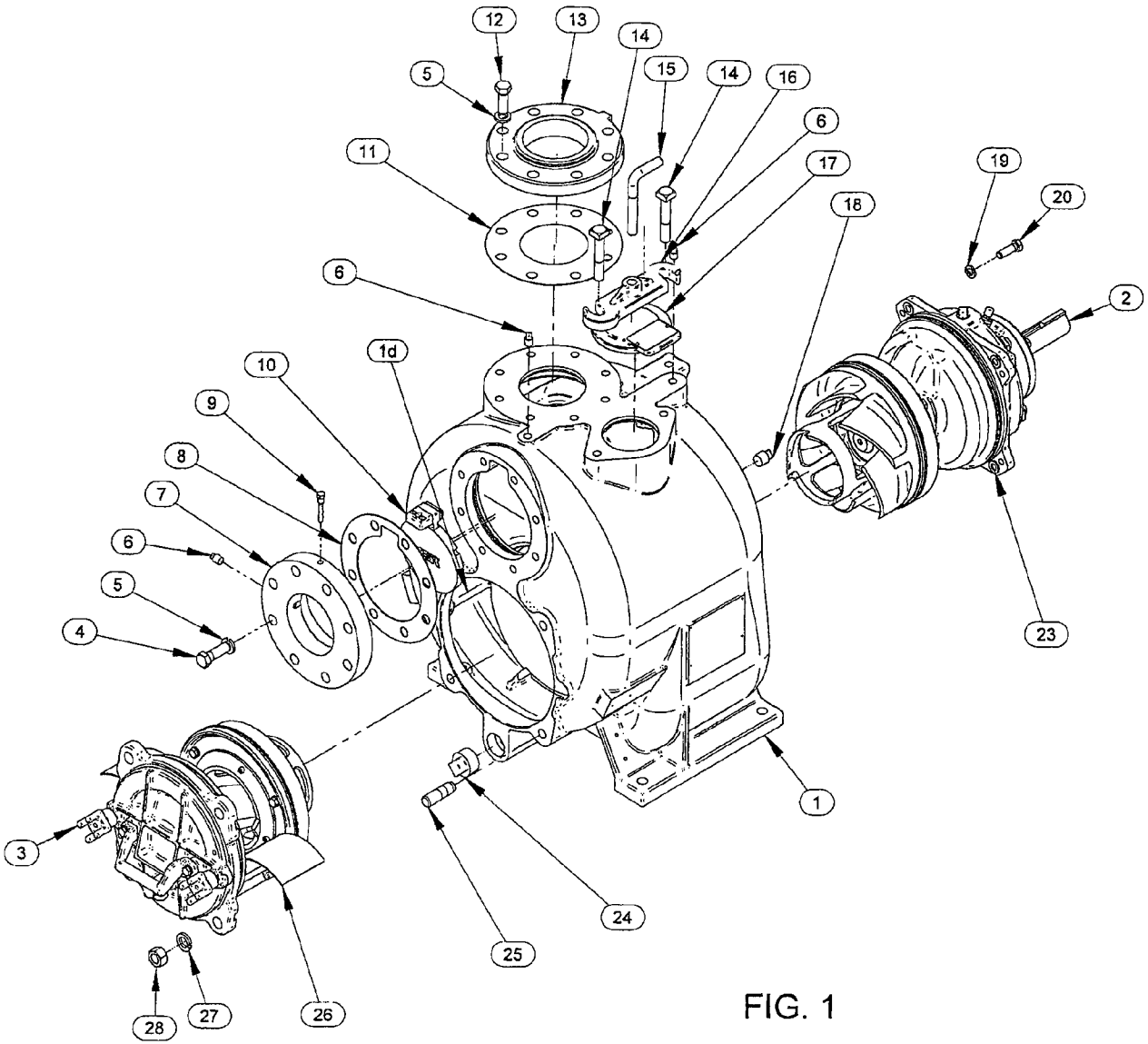
FIG. 1 is an isometric exploded assembly view of a self-priming pump according to one embodiment of the present disclosure.

According to one embodiment of the present disclosure, a pump has a self-priming volute housing 1, as shown in FIG. 1. However, other embodiments encompass a wide range of different volute styles, as many aspects of the disclosed design are not limited to use on self-priming pumps. Typically, the volute housing 1 is made of iron, however, various other metals known in the art for increased hardness or corrosion resistance are acceptable as well.

A suction flange 7 is attached to the volute housing 1 by capscrews 4 and lockwashers 5. The suction flange 7 also mounts against a gasket 8. A suction flap valve assembly 10 is pinned in place by the check valve pin 9 and seals against the suction flange 7. A pipe plug 6 provides access to attach an optional gauge (not depicted).

Attached to the volute housing 1 is an additional pipe plug 6 as an alternate location for gauge location (not depicted). The discharge flange 13 and gasket 11 are attached by capscrews 12 and lockwashers 5. On the top of the volute housing 1 is a cover plate assembly that consists of a cover assembly 17, two machine bolts 14, a clamp bar 16, and a screw-clamp bar 15. The cover plate assembly is removable to fill the volute housing 1 with fluid prior to its initial prime or at any point after the volute housing 1 has been drained. Draining the volute housing 1 is accomplished by the removal of a pipe plug 24.

Pipe plug 18 plugs a hole in the volute housing 1 that can be used either as a location for an optional item such as a casing heater (not depicted) or as an alternate drain location if the drain port filled by pipe plug 24 is unavailable.

Figures 2A, 2B:
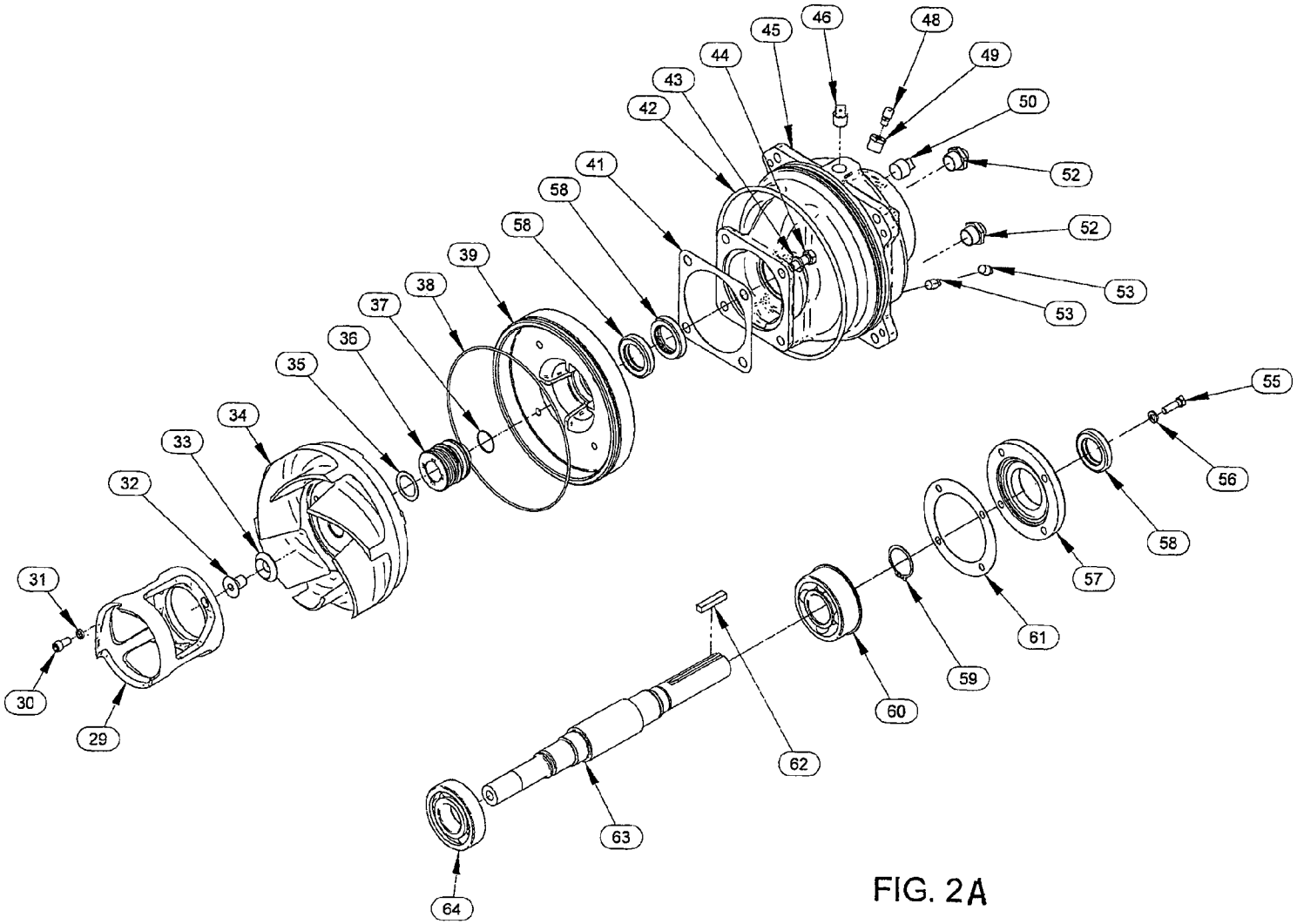
FIGS. 2A-B are isometric exploded assembly views of a rotating assembly of the pump of FIG. 1.

An impeller shaft 63, as shown in FIGS. 2A-B, is typically made out of an alloy steel or a hardened material such as 17-4 PH. A double row ball bearing 60, secured in place axially by a snap ring 59, is mounted directly on the impeller shaft 63. A single row ball bearing 64 is mounted on the other end of the impeller shaft 63.

Two lip seals 58 are pressed into a bearing housing 45 from the inboard side to separate oil cavities for the mechanical seal and the ball bearings 64 and 60. The impeller shaft 63 is then slid into the bearing housing 45 from the outboard side. Lip seal 58 is then installed into bearing cap 57. Capscrews 55 and lockwasher 56 hold bearing cap 57 and gasket 61 in place. Pipe plugs 53 provide drains for the mechanical seal oil and bearing oil reservoirs. Sight gauges 52 provide viewing of the oil level in the mechanical seal oil reservoir 45*b* and bearing oil reservoir 45*c*. Pipe plug 50 plugs an alternate sight gauge 52 location. Vented pipe plug 46 provides an access area to fill the mechanical seal oil reservoir 45*b*. The vented pipe plug 46 provides for relief of any pressure that may be generated due to the spinning of the shaft and any heat rise in the mechanical seal oil reservoir 45*b*. Removal of the reducer pipe bushing 49 provides access to fill the bearing oil reservoir 45*c*. Air vent 48 provides a means for any pressure buildup within the bearing housing 45 to escape while preventing moisture from getting into the bearing oil reservoir 45*c*.

Gasket 41 is placed between the seal plate 39 and the bearing housing 45. Capscrews 44 and lockwasher 43 secure the seal plate 39 to the bearing housing 45. Typically, seal plate 39 is hardened if necessary to reduce wear. Austempered ductile iron is one example of an acceptable material, although other strong metals known in the art are optionally used.

As shown in FIG. 5, cartridge seal 36 is installed axially along the impeller shaft 63 until it bottoms out in the seal plate 39. Cartridge seal 36 consists of hard seal faces such as silicon-carbide or tungsten carbide. Adjustable shim set 35 is installed to allow for adjustment of the clearance between the seal plate 39 and the impeller pump out vanes 34*c*. Impeller 34 is installed onto impeller shaft 63. Typically, the impeller 34 is hardened. Austempered ductile iron is one acceptable material, although other strong metals known in the art are optionally used. Flat head socket screw 32 passes through impeller washer 33 and is threaded into impeller shaft 63. Rotating cutter 29 is secured to the impeller 34 with socket head capscrews 30 and high collar lock washers 31. Rotating cutter 29 is manufactured out of a hardened stainless steel to increase its life.

O-ring 38 is installed in the groove around the outer diameter of the seal plate 39 of the rotating assembly 2. O-ring 42 is installed in the groove around the outer diameter of the bearing housing 45 of the rotating assembly 2. Once these are in place, the rotating assembly 2 is inserted into the volute housing 1. A set of adjustable shims 23 is installed between the rotating assembly 2 and the volute housing 1. The capscrews 20 pass through a lockwasher 19, the bearing housing 45 of the rotating assembly 2, and the adjustable shims 23. The capscrews 20 is tightened into the volute housing 1 to hold the rotating assembly 2 in position. Key 62 is inserted into the keyway in the impeller shaft 63.

Figure 3:
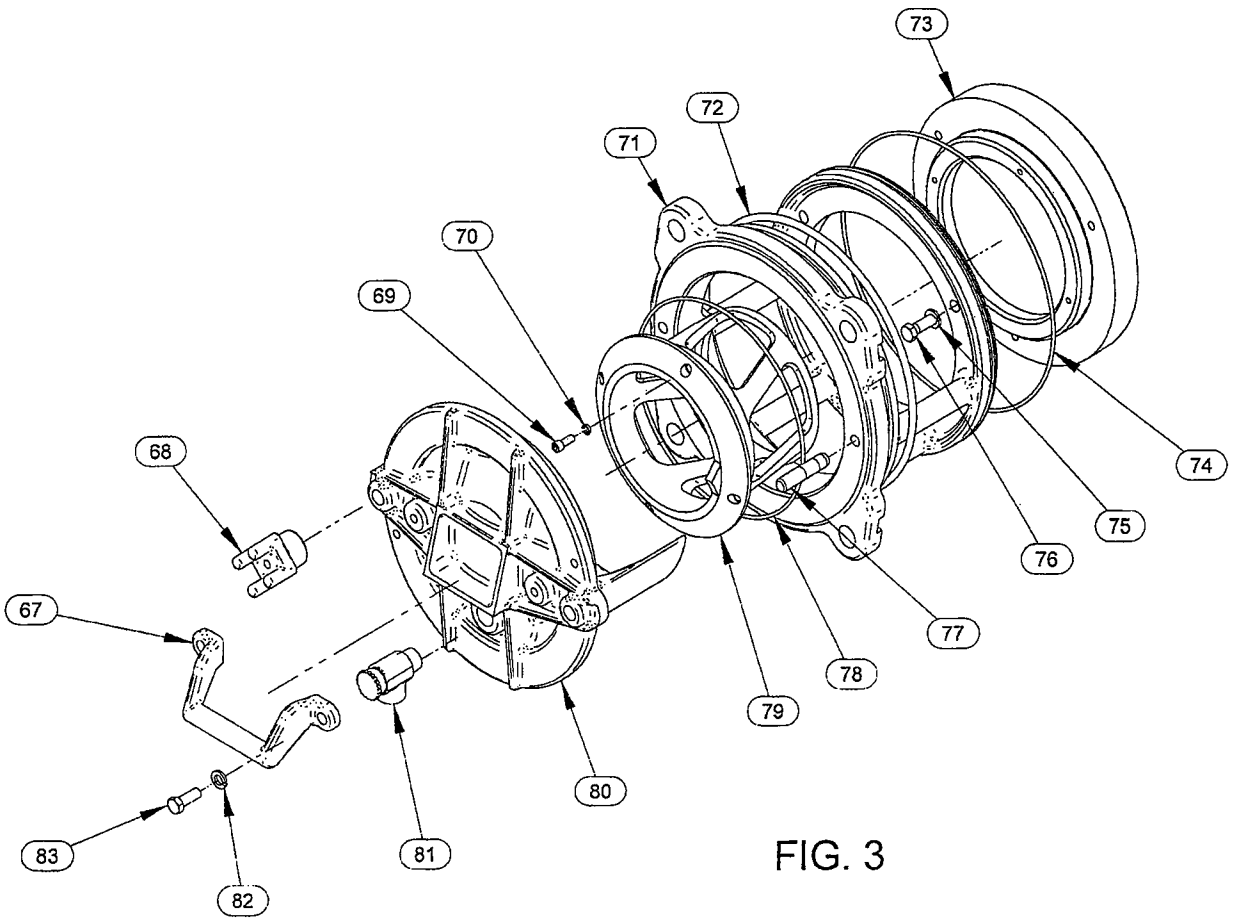
FIG. 3 is an isometric exploded assembly view of a back cover assembly of the pump of FIG. 1.

In FIG. 3, wear plate 73 is secured to back cover plate 71 by capscrews 76 and lockwashers 75. Wear plate 73 is made of a hardened material, although other hard materials known in the art are optionally used. Stationary cutter 79 is passed through the opening in back cover plate 71 and attached to the wear plate 73 by socket head capscrews 69 and high collar lockwashers 70. Stationary cutter 79 is made out of a hardened stainless steel to increase its life.

As also shown in FIG. 1, a pump comprising a volute housing 1, a rotating cutter 29 having at least one blade parallel to a rotational axis of the rotating cutter 29, an impeller 34 arranged at an outer circumference of the rotating cutter 29, and a stationary cutter 79 having at least one blade parallel to the rotational axis of the rotating cutter 29. The stationary cutter 79 is concentric with the rotating cutter 29, and the stationary cutter 79, the rotating cutter 29 and the impeller 34 are all at least partially housed within the volute housing 1.

Pressure relief valve 81 is attached to inspection cover 80. Inspection cover 80 is typically manufactured out of a variety of metals or polymers, suitable for use and known to those skilled in the art. Polymers may be preferred to minimize the weight of the part. Handle 67 is secured to the inspection cover 80 by capscrews 83 and lockwashers 82. O-ring 78 is installed in the groove in inspection cover 80.

Studs 77 are threaded into the back cover plate 71. The inspection cover 80 is then slid into the back cover plate 71 along studs 77 and is secured by hand knobs 68. O-ring 74 is installed in the groove in the outer diameter of the back cover plate 71.

Figure 4B:
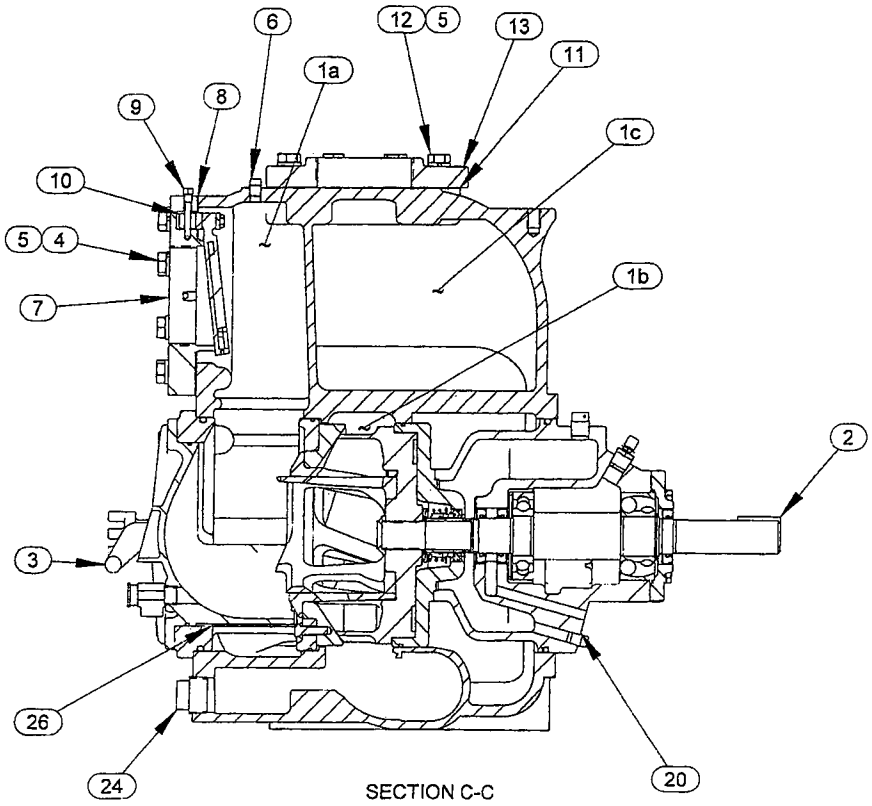
FIGS. 4A-B are a front view and a cross-sectional view of the pump of FIG. 1.
Figure 4A:
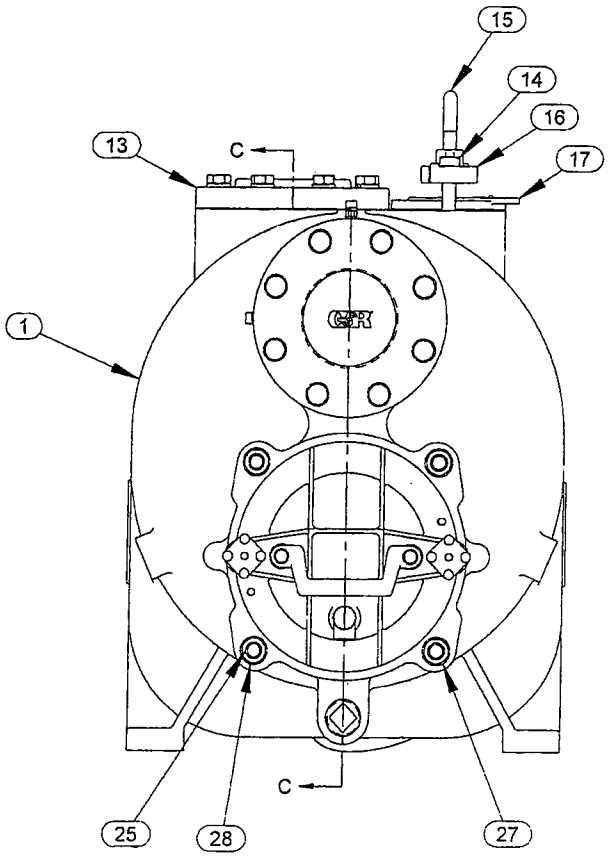

As depicted in FIG. 4A, four studs 25 are inserted into the volute housing 1. The close out strip suction 26 is installed on the posts of the back cover plate 71 prior to installing the back cover assembly 3. The close out strip suction 26 is made of a flexible elastomeric material that allows the part to conform to the shape of the back cover plate 71 and the volute housing 1. The back cover assembly 3 is piloted into the volute housing 1 and along the studs 25 until it bottoms out against the volute housing 1. Hex nut 28 and lockwasher 27 are used to secure the back cover assembly 3 to the volute housing 1 along the studs 25.

During pump operation, the pumpage, including suspended solids, enters thru the suction flange 7, as shown in FIG. 4B. It then passes into the suction chamber of the volute housing 1*a*. The pumpage is then drawn into the rotating cutter 29 by the pumping action of the impeller 34. The pumpage passes between the rotating cutter 29 and the stationary cutter 79, at which point the suspended solids are sheared into smaller segments. The pumpage then flows through the impeller 34 and is discharged out into the volute housing scroll 1*b*. The pumpage then flows out through the rear portion of the volute housing 1*c*, and then exits the volute housing 1 through the discharge flange 5.

As is depicted in FIG. 3, the inspection cover 80 is easily removed to allow for inspection of the rotating cutter 29 and the stationary cutter 79. If any suspended solids were not passed through the pump, the inspection cover 80 is removed to grant access to remove the remaining solids. The inspection cover 80 also allows the operator to inspect the condition of both the rotating cutter 29 and the stationary cutter 79 and make replacements if necessary. The hand nuts 68 shown are hand-tight hardware allowing for easy removal of the inspection cover 80 without requiring any tools, but optionally uses standard hex nuts or other common hardware. Also incorporated into the inspection cover 80 design are two threaded holes for use in pushing the inspection cover 80 out of the back cover plate 71 if necessary.

In another embodiment of the present disclosure, the inspection cover 80 includes a "scoop" to improve the hydraulic flow into the eye of the rotating cutter 29. This scoop is optionally used in place of the close out strip suction 26. This scoop is placed in very close proximity to at least two of the back cover plate posts 71*a*, reducing the flow area around the back cover posts 71*a*, and thereby reducing the possibility of stringy material wrapping around the back cover posts 71*a*. Alternatively, the scoop is part of the back cover plate 71 in place of some or all of the back cover plate posts 71*a*.

The number of blades 79*a* on the stationary cutter 79 and the number of blades 29*a* on the rotating cutter 29 can be varied. To shear the suspended solids into smaller segments, the number of blades 29*a* and 79*a* on either or both cutters is increased. Alternatively, increasing the rotational speed of the pump or reducing the flow rate through the pump also shears the suspended solids into smaller segments. Increasing the number of blades 29*a* and 79*a* increases the blockage in the flow path which in turn usually results in lower overall hydraulic efficiency or increased net positive suction head required (NPSHR).

Figure 7:
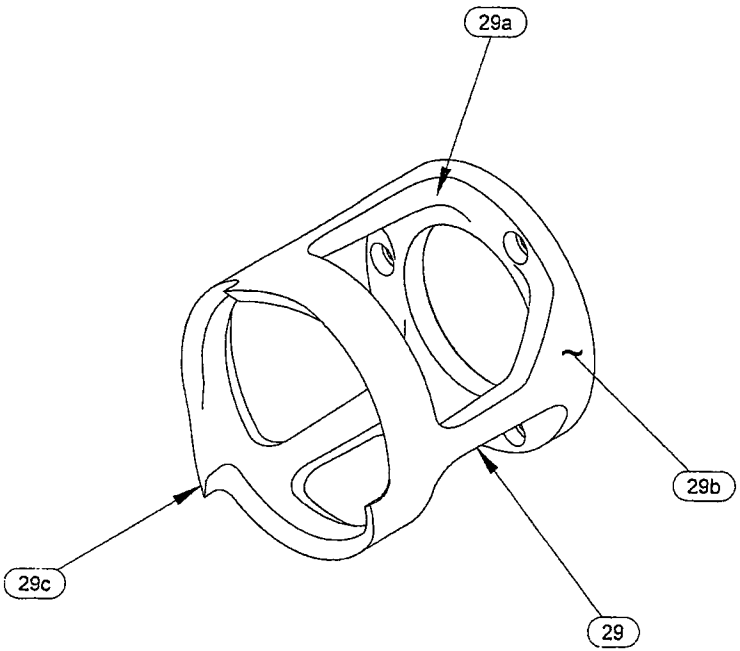
FIG. 7 is an isometric view of the rotating cutter according to another embodiment of the present disclosure.

While the number of blades 79*a* on the stationary cutter 79 and the number of blades 29*a* on the rotating cutter 29 can vary, it is preferred to maintain their relationship such that only one rotating blade 29*a* is passing one stationary blade 79*a* at any instant. This allows the full torque available from the power source to be available to shear the suspended solids at any given instant. As shown in FIG. 7, there are three blades 29*a* on the rotating cutter 29 and five blades 79*a* on the stationary cutter 79.

Figure 6:
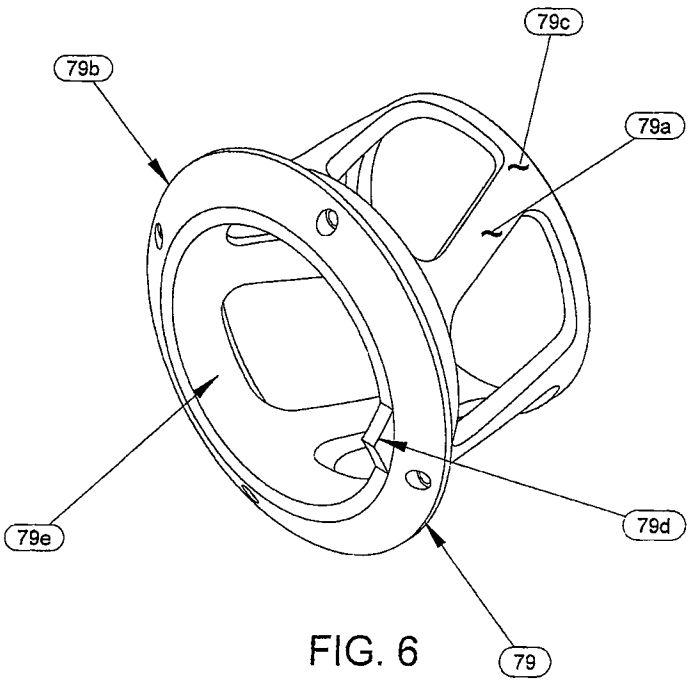
FIG. 6 is an isometric view of a stationary cutter according to another embodiment of the present disclosure.

FIGS. 6 and 7 show how the shape of the stationary cutter inlet 79*b* is rounded or angled to allow for better hydraulic flow into the rotating cutter 29, improving pump efficiency and lowering NPSHR. The outer diameter of the stationary cutter inlet 79*b* is limited to the opening in the back cover plate 71. This enables removal of both the rotating cutter 29 and the stationary cutter 79 through the back cover plate 71 with the inspection cover 80 removed. This allows for easier cutter replacement while the pump is installed as an operator does not need to make any modifications to the drive, the plumbing, or even remove the entire back cover assembly 3. No clearances need to be reset making this change.

Figure 8B:
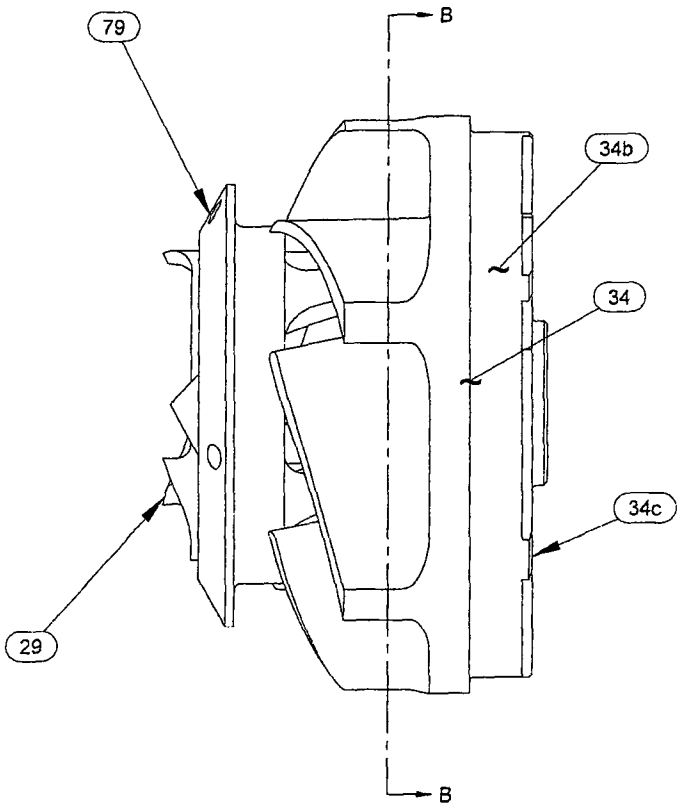
FIGS. 8A-B are a sectional view and side view of the impeller, rotating cutter, and stationary cutter according to another embodiment of the present disclosure.
Figure 8A:
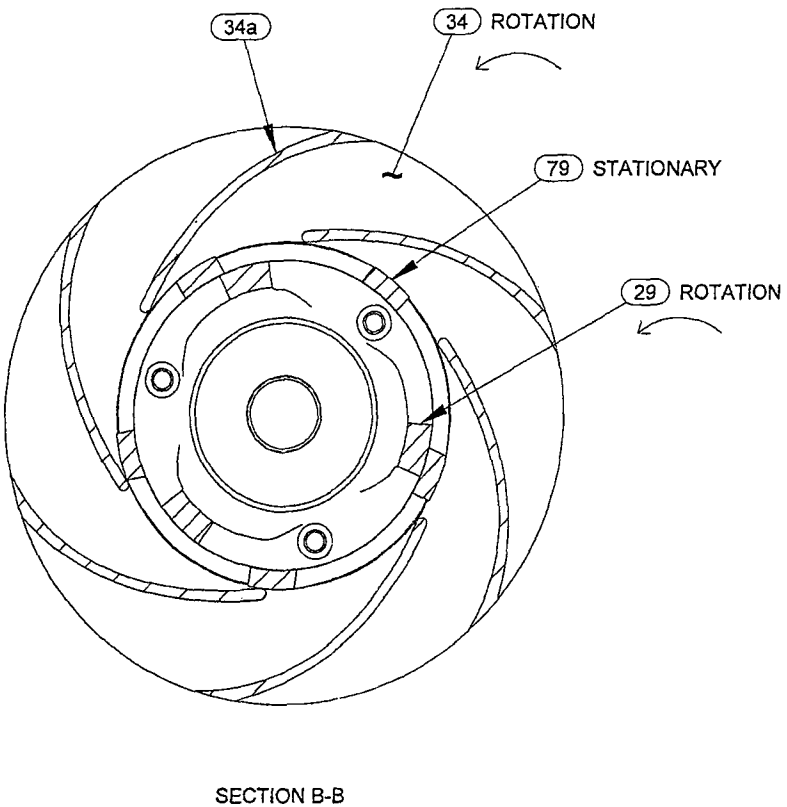

As shown in FIG. 8, the stationary cutter 79 also provides protection to the impeller 34 to wear plate 73 clearance. Since this is an area of high wear on many pumps, including chopper pumps, the stationary cutter 79 design increases the life of both the wear plate 73 and the impeller 34. Incorporating self-cleaning grooves or notches in the wear plate 73 is also envisioned.

The rotating cutter blade 29*a* and stationary cutter blade 79*a* designs are such that as the rotating cutter 29 rotates, there is a constantly decreasing area between the blades 29*a* and 79*a* as the impeller shaft 63 rotates. This smooths the flow, reduces the radial load during shearing, and makes use of the entire axial length of the blades 29*a* and 79*a*. There is more cross-sectional area on the rotating cutter blade 29*a* closer to the impeller to increase the rigidity of the blade 29*a* along its axial length.

The present design allows for more "cutting flow area". The cross-sectional flow area for today's chopper pumps is basically the area of a circle. The present design increases that area dramatically by making it the surface area of a cylinder.

Conventional chopper pumps experience significant axial loads as the suspended solids are forced between the impeller and their cutter bars. The present disclosure, however, virtually eliminates this type of axial load due to the plane in which the cutting is occurring. All shearing is done such that only radial loads are transferred to the impeller shaft 63.

The outer diameter of the rotating cutter 29 and the inner diameter of the stationary cutter 79 are machined with a tight radial clearance. This tight clearance prevents stringy suspended solids from getting caught between the outer diameter of the rotating cutter 29 and the inner diameter of the stationary cutter 79. This clearance is limited primarily by manufacturing tolerances. There is also a relatively tight radial clearance between the outer diameter of the stationary cutter 79 and the impeller vanes 34*a*. This additional radial clearance allows the impeller vanes 34*a* to both wipe off the stationary cutter vanes 79*a* and also to optionally serve as a secondary set of rotating cutter blades. In other embodiments, the rotating cutter 29 is removed and the impeller vanes 34*a* designed such that they work in conjunction with the stationary cutter blades 79*a* as the sole cutting interface.

Optionally, the rotating cutter 29 and the stationary cutter 79 are manufactured with tapered surfaces. A tapered surface on the outer edge of the rotating cutter 29*b* is sloped toward the back cover plate 71 and a tapered surface on the inner edge of the stationary cutter 79*c* sloped away from the back cover plate 71. These surfaces, 29*b* and 79*c*, would allow for axial adjustment of the cutting clearances between the rotating cutter 29 and the stationary cutter 79.

As shown in FIG. 9, the rotating cutter 29 optionally incorporates axial protrusions 29*c* at its inlet. The protrusions 29*c* encompass a number of different geometric shapes, but are intended to act somewhat like a hole saw. If any long, somewhat rigid solid such as a stick were to bridge across the opening in the stationary cutter 79, these protrusions 29*c* will either break that solid into pieces or knock it back off of the stationary cutter 79 opening. This prevents the opening in the stationary cutter 79 from becoming partially blocked. Such a blockage could lead to decreased efficiency, increased NPSHR, or for other solids suspended in the pumpage to build up behind the blockage. The number, orientation, and shape of these protrusions 29*c* varies depending upon the actual application in question. Some of the geometric shapes conceived for these protrusions 29*c* include saw tooth, shark tooth (somewhat as shown), sine wave, and square tooth profiles, as shown in FIGS. 10-12.

The stationary cutter 79 includes a protrusion 79*d* on its face that serves to "wipe" off any stringy matter that could have gotten caught on the rotating cutter protrusions 29*c*. In another embodiment, grooves or notches are placed in the stationary cutter inlet 79*b* to "catch" and knock loose stringy material that may have wrapped around the protrusions 29*c* on the rotating cutter 29. These grooves or notches optionally extend down into the inner diameter of the stationary cutter 79*e*. Various embodiments feature a single groove or notch, a combination of the two, or multiple of each. The grooves and notches are optionally used in combination with a protrusion 79*d* on the stationary cutter 79. Due to the protrusions 29*c* on the rotating cutter 29 and the protrusion 79*d* or grooves on the stationary cutter inlet 79*b*, optional devices for stringy solids are no longer necessary.

In some extreme embodiments, the pump reverses its rotation to clear a blockage. Some motor control specialists have developed routines to recognize clogging and to run non-clog pumps in reverse to attempt to dislodge the stringy matter causing the buildup. In these or similar cases, a rotating cutter 29 is designed such that its blade shapes 29*a* were symmetric in allowing shearing action in either direction of rotation as shown in FIG. 9. Changes could also be made to the protrusions 29*c* on the rotating cutter 29 and also protrusions 79*b* or the notches and grooves in the stationary cutter inlet 79*b* to allow for this mode of operation.

In another embodiment, the pump comprises nesting multiple rotating cutters 29 and stationary cutters 79. This would provide for smaller final solids. Optionally, the stationary cutter 79 pilots into the rotating cutter 29.

The stationary cutter blades 79*a* and the rotating cutter blades 29*a* are resharpened by grinding if they begin to dull over time. This does not impact any axial clearances within the pump. Conventionally, if a chopper pump's impeller begins to wear at the cutting surface, resetting the impeller to wear plate clearance correctly is difficult due to the uneven wear across the face of the impeller vanes 34*a*. This leads to increased axial clearances at the shearing interface between the impeller vane and the cutter bar.

In other embodiments, the wear plate 73 and the stationary cutter 79 are incorporated into one single piece. Optionally, the impeller 34 and the rotating cutter 29 are incorporated into one single piece. While these combinations would limit the flexibility in the design and increase repair expense, they provide design alternatives to the present disclosure.

In the present disclosure, the wear plate 73 is not part of the shearing process within the pump which results in an increased lifetime for the wear plate 73. The wear plate 73 does not need to be replaced or have its clearance to the impeller 34 reset to renew cutting clearances. This enables the operator to reset the impeller 34 to wear plate 73 clearance without being concerned about the cutting clearances. This is an improvement over existing designs where resetting this impeller to wear plate clearance is also resetting the cutting clearances. The wear plate 73 is shown with a tapered face, but could also be produced with a flat face if appropriate. The wear plate 73 could be made from a casting or as a fabrication from plate.

The impeller vanes 34*a* at the eye of the impeller 34 optionally are designed to act as a cutting mechanism as they run concentrically around the stationary cutter 79. The impeller vanes 34*a* can either be aligned with the rotating cutter blades 29*a* or be out of phase with the rotating cutter blades 29*a*. This allows the pump to still operate as a chopper pump if the rotating cutter 29 is removed. Further, even with both the rotating cutter 29 and the stationary cutter 79 removed, the pump is able to operate since the impeller 34 is still operational. Conventional chopper pumps do not have this feature. Preliminary lab testing on one hydraulic demonstrated that an increase in efficiency at best efficiency point (BEP) was between 3 and 4% was achieved in running the pump without the rotating cutter 29 or the stationary cutter 79. While BEP was at approximately the same flow for both tests, roughly 10% more maximum flow was achieved running the pump without the rotating cutter 29 and the stationary cutter 79. Very minimal difference was seen in the head-capacity curves generated. It is thus expected that a pump with the rotating cutter 29 and the stationary cutter 79 removed could operate at approximately the same condition point as the pump with a rotating cutter 29 and a stationary cutter 79 installed as long as the pump is operating within its allowable operating range.

The impeller 34 is easily replaced with a different impeller with different geometry for the impeller vane 34*a* layout without needing to replace either the rotating cutter 29 or the stationary cutter 79. The different impeller vanes 34*a* can allow for the pump to operate at a different condition point. Since most chopper pumps today use the impeller as the cutting mechanism, this feature is not present. This also allows that once wear has begun, the impeller 34, the rotating cutter 29, and the stationary cutter 79 can all be replaced strictly on an as-needed basis. This increases the life of the parts by only requiring what is worn to be replaced.

The impeller 34 is partially nested in the seal plate 39 as shown in FIG. 4. This provides a large reduction in the amount of suspended solids getting behind back shroud of the impeller 34*b* and into the seal bore where the cartridge seal 36 operates. Other chopper pump designs have stringy debris wrapping around the seal spring, which causes premature seal failures to occur. The present nested design in combination with pump out vanes 34*c* on the back shroud of the impeller 34*b* will virtually eliminate any debris from accumulating in the seal area. Seal plate 39 could be entirely hardened or possibly selectively hardened or coated/flame sprayed with a hard material around where the back shroud of the impeller 34*b* nests into it to increase its life further. Other chopper pumps incorporate a separate cutter behind the impeller to reduce the size of the solids that are present in the seal chamber. The present design works to prevent those solids from getting into the seal chamber, thus eliminating the need for this upper cutter.

Impeller 34 is shown as a semi-open impeller. This could be replaced by a fully enclosed impeller, or a vortex impeller. Impeller 34 is also shown with a threaded attachment to the impeller shaft 63, but this is easily changed to a keyed connection. If a keyed connection is used, it is possible to size the key such that it shears prior to extensive damage occurring to the rotating cutter blades 29*a* if a severe clog were to occur.

Seal plate 39 optionally incorporates notches or grooves in the area immediately behind the impeller pump out vanes 34*c*. These cause disturbance in the flow and also act in conjunction with the impeller pump out vanes 34*c* to shear any suspended solids that get behind the back shroud of the impeller 34*b*.

Figure 13B:
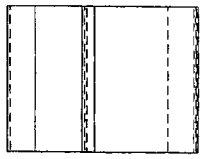
FIGS. 13A-B are drawings of the close out suction according to another embodiment of the present disclosure.
Figure 13A:
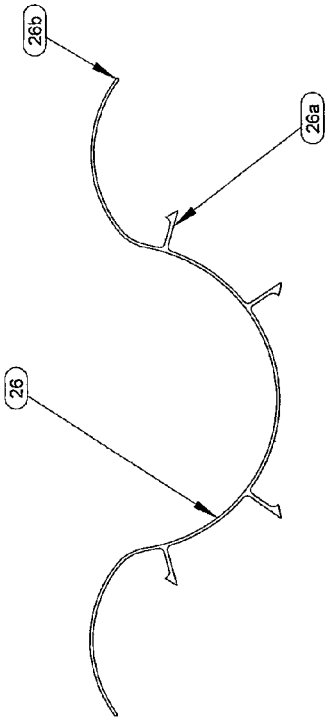

As shown in FIGS. 13A-B, close out strip suction 26 effectively prevents any flow around the back cover plate posts 71*a*. This helps to channel all pumpage directly into the rotating cutter 29. The close out strip suction 26 must be nearly the full length of the volute housing suction chamber 1*a* in order to effectively serve its purpose. The close out strip suction openings 26*a* slide over the back cover plate posts 71*a* to hold it in place. The close out strip suction 26 can be installed or removed through the inspection cover 80. The wings of the close out strip suction 26*b* rest on ribs 1*d* within the volute housing 1, preventing any flow from getting below and guiding the flow in the pump toward the eye of the impeller 34. This in effect can raise the pump efficiency and lower the pump NPSHR.

Figure 14B:
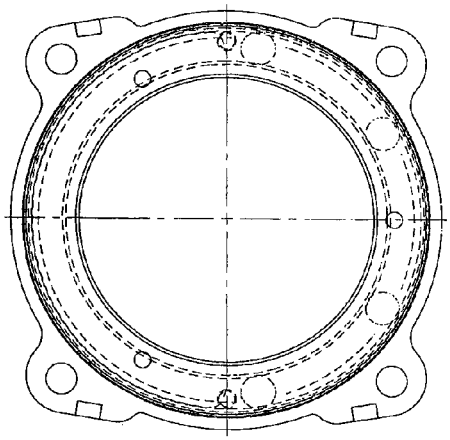
FIGS. 14A-B are drawings of the back cover plate and posts according to another embodiment of the present disclosure.
Figure 14A:
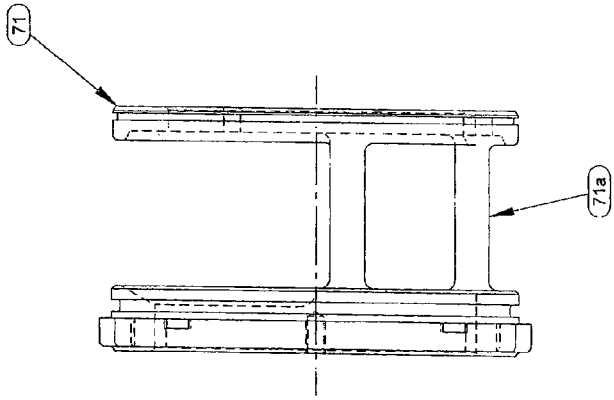

As shown in FIGS. 14A-B, the back cover plate posts, or connectors 71*a* are all below the centerline of the back cover plate 71. This moves them more out of the way and allows the close out strip suction 26 to rest fully below the eye of the rotating cutter 29. In installations where the close out strip suction 26 is not used, the posts 71*a* are kept out of the primary flow path of the pumpage, thereby reducing the amount of stringy material that can wrap around the back cover plate posts 71*a*. In other embodiments, the back cover plate posts 71*a* are separate components instead of cast as one piece.

Figure 5A:
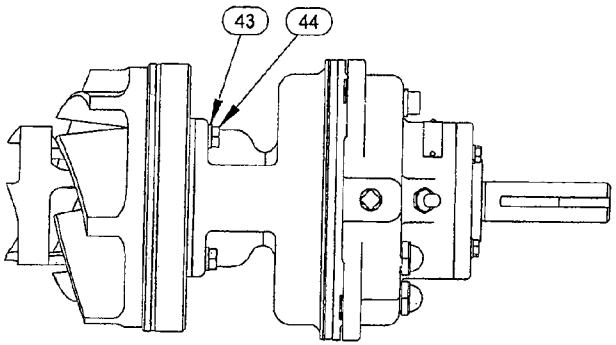
FIGS. 5A-D are various views of the rotating assembly of the pump of FIG. 2.
Figure 5C:
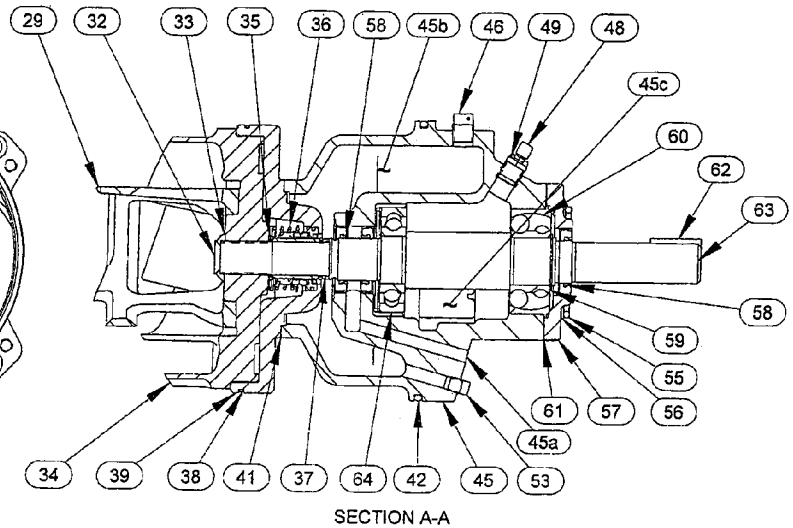
Figure 5D:
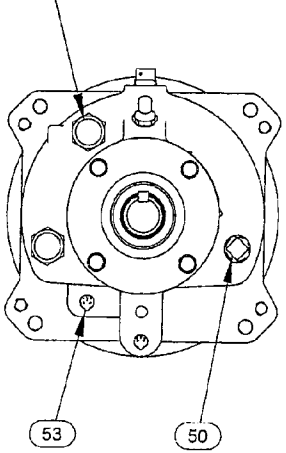
Figure 5B:
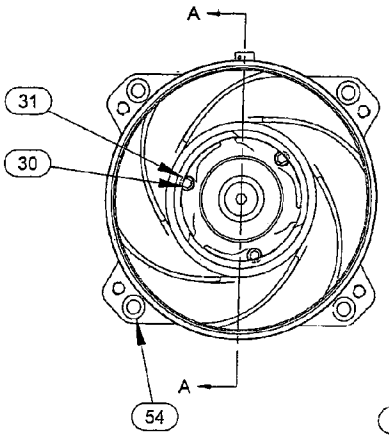

As shown in FIG. 5C, an atmospheric vent 45*a* is provided between the seal oil reservoir 45*b* and the bearing oil reservoir 45*c*. This feature protects the bearings in the event of a seal failure of both the cartridge seal 36 and the seal oil reservoir lip seal 58. This feature is not available on conventional chopper pumps, and therefore a seal failure can also lead to needing to replace bearing 64 and bearing 60 as well.

The overall pump classification includes any of a self-primer (as shown), a submersible, a straight centrifugal, a priming-assisted centrifugal, or a vortex pump. The pump is optionally powered by a gasoline or diesel engine, an electric motor, a hydraulic motor, or driven off of a turbine. In some of these other embodiments, the shaft of the driver would replace the impeller shaft 63.

In field applications where system requirements lead to staging pumps in series, it is conceivable that only the first pump needs to be a chopper pump. However, there are instances where chopper pumps need to be run in series with other chopper pumps. The volute housing 1 is designed to withstand this increased operating pressure.

In other embodiments, any of the above features of the rotating cutter 29 and the stationary cutter 79 are incorporated into a device that would operate outside of a volute housing 1 as a stand-alone design. This device is optionally mounted ahead of any standard pump to chop up suspended solids prior to them entering into the pump instead of once they are already inside of the pump.

Figure 15B:
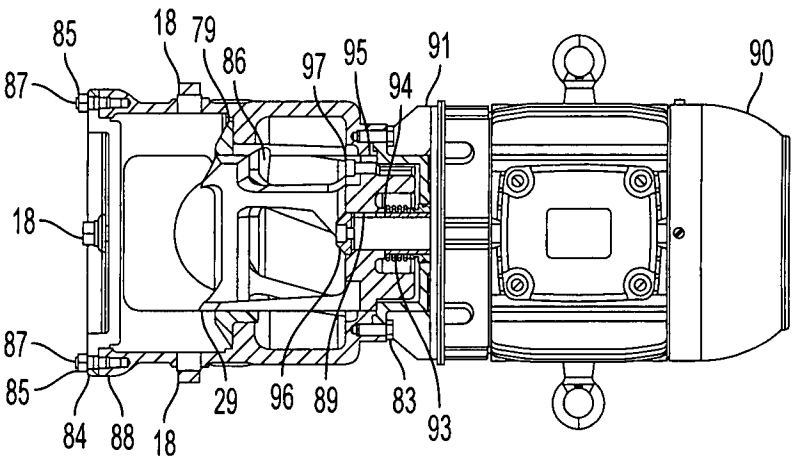
FIGS. 15A-B are end and side views of a stand-alone chopper according to another embodiment of the present disclosure.
Figure 15A:
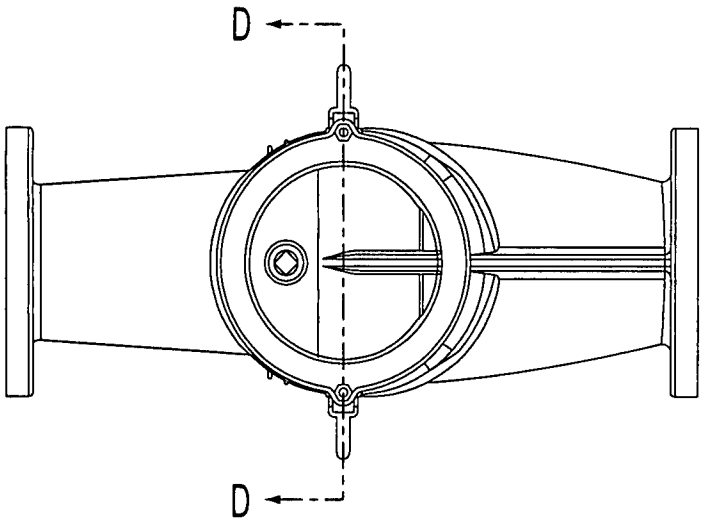
Figures 16A, 16B:
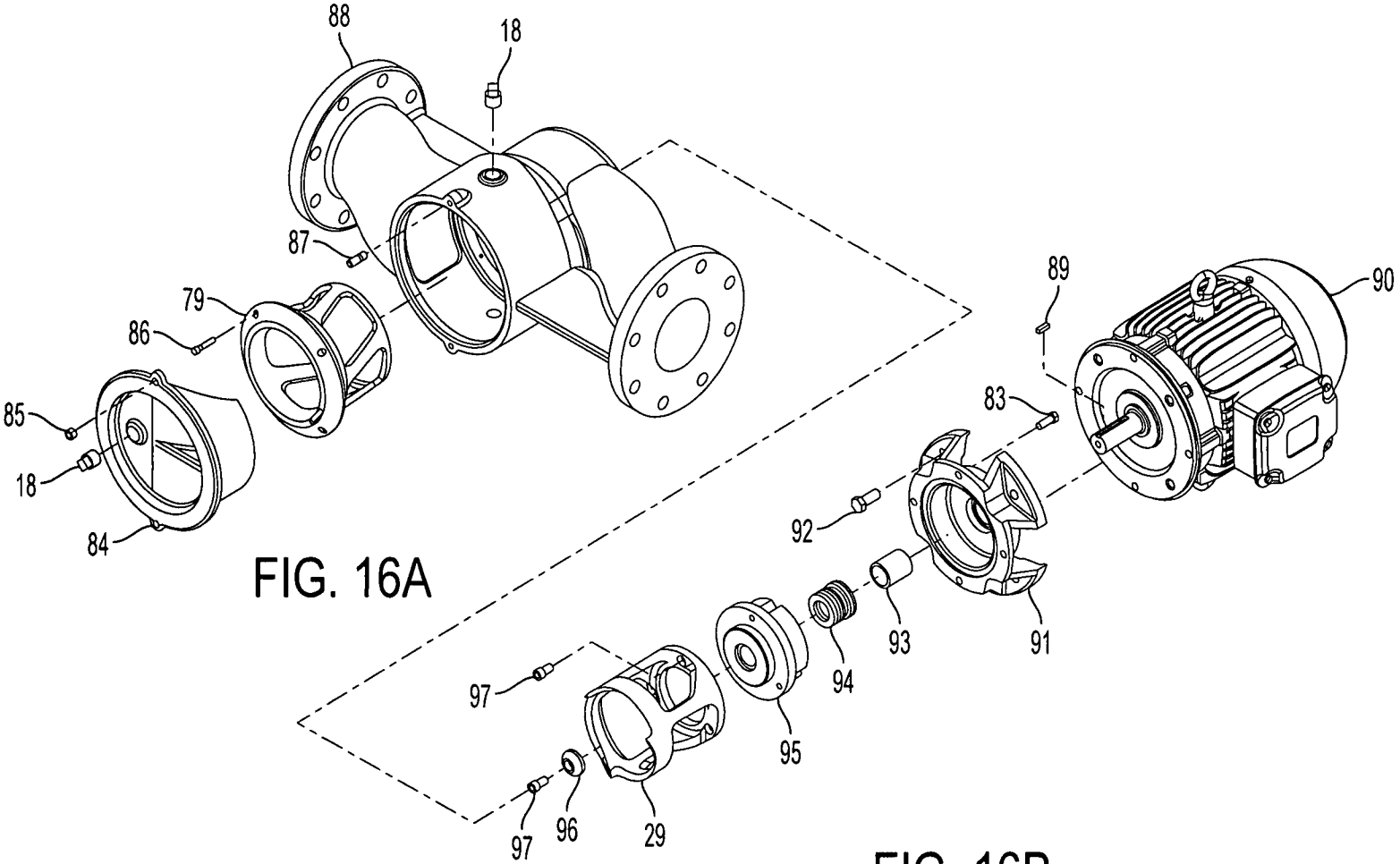
FIGS. 16A-B are isometric exploded assembly views of a housing and chopper according to another embodiment of the present disclosure.

In another embodiment of the present disclosure, a chopper device employing the rotating cutter and stationary cutter as described above is presented. The operation of the chopper is similar to that of the pump disclosed, but without the pumping mechanism, so only minor differences are pointed out here. As shown in FIGS. 15 and 16, a chopper comprising a housing 88, a rotating cutter 29 having at least one blade parallel to a rotational axis of the rotating cutter; and a stationary cutter 79 having at least one blade parallel to the rotational axis of the rotating cutter 29. The stationary cutter 79 is concentric with the rotating cutter 29, and the stationary cutter 79 and the rotating cutter 29 are all at least partially housed within the housing 88.

the volute housing of the pump is replaced by housing 88, and would be made of similar materials. FIGS. 15 and 16 depict inlet and discharge ports 180° opposite of each other. Optionally, these ports are 90° apart.

In other embodiments, the housing 88 is made of two separate components such that the ports can be indexed to any number of different positions relative to each other to allow for optimum flexibility in meeting application requirements. Instead of an impeller shaft, the rotating cutter 29 is shown mounted directly on the shaft of the electric motor 90. Optionally, the electric motor 90 is replaced with an engine or hydraulic motor. Alternatively, there is a complete shaft arrangement to allow for an external drive such as the drive on the pump of FIG. 1. The orientation during installation is only limited by what orientation the driver is capable of operating in. Therefore, this unit is optionally mounted with the driver shaft either horizontal or vertical.

Intermediate 91 serves the purpose of coupling the housing directly to the driver. Inspection cover 84 serves the same purpose as the previously discussed inspection cover. Instead of mounting on the back cover plate 71, the stationary cutter 79 is mounted directly to the housing 88. The life of the stationary cutter 79 can be increased in this variation by periodically rotating it within the housing 88. This is due to the fact that nearly all of the cutting occurs along only one of the stationary cutter blades 79*a*. Hub 95 is the means of attaching the rotating cutter 29 to the electric motor 90. Optionally, the rotating cutter 29 and the hub 95 are combined into one component.

The present disclosure can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the disclosure. However, it should be recognized that the present disclosure can be practiced without resorting to the details specifically set forth. In other instances, well known processing structures have not been described in detail, in order not to unnecessarily obscure the present disclosure.

Only a few examples of the present disclosure are shown and described herein. It is to be understood that the disclosure is capable of use in various other combinations and environments and is capable of changes or modifications within the scope of the inventive concepts as expressed herein.

What is claimed is:

1. A pump comprising:

a volute housing;

a rotating cutter having at least one blade parallel to a rotational axis of the rotating cutter;

an impeller arranged at an outer circumference of the rotating cutter, and a stationary cutter having at least one blade parallel to the rotational axis of the rotating cutter;

wherein:

the stationary cutter is concentric with the rotating cutter, the inner diameter of the eye of the impeller is greater than an outer diameter of the stationary cutter, and the stationary cutter, the rotating cutter and the impeller are configured to direct flow of a solid radially through the impeller, and are all at least partially housed within the volute housing.

2. The pump of claim 1, wherein the rotating cutter has a different number of blades than the stationary cutter.

3. The pump of claim 1, further comprising an inspection cover that is removably attached to the pump, wherein upon removal of said inspection cover an opening is created that is large enough to remove the stationary cutter and the rotating cutter from the volute housing.

4. The pump of claim 1, wherein the stationary cutter has a groove or protrusion.

5. The pump of claim 1, wherein said rotating cutter has a terminal end, and said terminal end comprises at least one protrusion along an axial direction of the rotating cutter.

6. The pump of claim 5, wherein the at least one protrusion is square-shaped.

7. The pump of claim 5, wherein the at least one protrusion is sine wave-shaped.

8. The pump of claim 1, including a back cover assembly housed at least partially within the volute housing, wherein said stationary cutter is removably attached to said back cover assembly.

9. The pump of claim 8, wherein the back cover assembly further comprises an inspection cover that is removably attached to the pump; and at least one connector for connecting the inspection cover and the back cover assembly, wherein the at least one connector is located below the centerline of the back cover assembly.

10. The pump according to claim 8, further comprising:

a wear plate attached to said back cover assembly, wherein an axial clearance between the impeller and the wear plate can be adjusted without affecting the clearance between the rotating cutter and the stationary cutter.

11. A pump according to claim 8, further comprising:

a wear plate attached to said back cover assembly, wherein a clearance between the impeller and the wear plate is adjusted by changing an axial location of the back cover assembly.

12. The pump of claim 1, wherein the impeller and the rotating cutter are separate components and the rotating cutter is removably attached to the impeller.

13. The pump of claim 1, wherein the impeller serves as the rotating cutter.

14. The pump of claim 1, wherein the pump is self-priming.

15. The pump of claim 1, wherein the impeller is a vortex impeller.

16. The pump of claim 1, wherein the pump is submersible.

17. The pump of claim 1, further comprising:

an impeller shaft located along a rotational axis of the rotating cutter;

a seal mounted on the impeller shaft;

a seal oil reservoir in communication with the seal;

at least one bearing mounted on the impeller shaft;

a bearing oil reservoir in communication with the bearing; and an atmospheric vent in communication with the seal oil reservoir and the bearing oil reservoir.

18. The pump of claim 1, wherein the impeller further comprises a plurality of vanes protruding radially from the impeller, wherein the number of vanes on the impeller is equal to the number of blades on the rotating cutter.

19. The pump of claim 1, wherein the impeller further comprises a plurality of vanes protruding radially from the impeller, wherein the number of vanes on the impeller is a multiple of the number of blades on the rotating cutter.

20. A pump comprising:

a volute housing;

an impeller at least partially housed within the volute housing; and a back cover assembly at least partially housed within the volute housing which includes a back cover plate, a wear plate and an inspection cover, wherein the wear plate is arranged on a side of the back cover plate opposite the inspection cover.

21. A chopper pump comprising:

a volute housing;

a rotating cutter;

a stationary cutter;

a back cover assembly, wherein the rotating cutter, the stationary cutter and the back cover assembly are housed at least partially within the volute housing;

an impeller;

an impeller shaft located along a rotational axis of the rotating cutter;

a seal mounted on the impeller shaft;

a seal oil reservoir in communication with the seal;

at least one bearing mounted on the impeller shaft;

a bearing oil reservoir in communication with the bearing; and an atmospheric vent in communication with the seal oil reservoir and the bearing oil reservoir.

22. A chopper comprising:

a housing;

a rotating cutter having at least one blade parallel to a rotational axis of the rotating cutter; and a stationary cutter having at least one blade parallel to the rotational axis of the rotating cutter;

wherein the stationary cutter is concentric with the rotating cutter, and the stationary cutter and the rotating cutter are configured to direct flow of a solid in a radial direction, and are all at least partially housed within the housing.

23. The chopper of claim 22, further comprising an electric motor having a shaft, wherein the rotating cutter is mounted directly on the shaft of the electric motor.

24. The chopper of claim 22, further comprising an inspection cover that is removably attached to the housing, wherein upon removal of said inspection cover an opening is created that is large enough to remove the stationary cutter and the rotating cutter from the housing.

* * * * *